US006776545B1

(12) United States Patent
Terao

(10) Patent No.: US 6,776,545 B1
(45) Date of Patent: Aug. 17, 2004

(54) IMPACT DOT PRINT HEAD AND A PRINTER INCLUDING THE SAME

(75) Inventor: Yasunobu Terao, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/376,268

(22) Filed: Mar. 3, 2003

(51) Int. Cl.[7] ..... B41J 2/275
(52) U.S. Cl. ..... 400/124.23; 400/124.24
(58) Field of Search ..... 400/124.11, 124.23, 400/124.24, 124.17

(56) References Cited

U.S. PATENT DOCUMENTS 4,548,521 A * 10/1985 Wirth et al. ..... 400/124.07
4,582,437 A * 4/1986 Wang ..... 400/124.2
4,915,524 A * 4/1990 Mitsuishi et al. ..... 400/124.24
6,513,997 B2 2/2003 Terao
6,543,944 B2 4/2003 Horii et al.

FOREIGN PATENT DOCUMENTS

JP 10-264421 10/1998
JP 11078075 A * 3/1999 ..... B41J/2/275

* cited by examiner

*Primary Examiner*—Daniel J. Colilla
(74) *Attorney, Agent, or Firm*—Oblon, Spivak, McClelland, Maier & Neustadt, P.C.

(57) ABSTRACT

In the impact dot print head of the present invention there is used an armature spacer having side yoke portions which extend away from cores of a yoke and confront armatures. With such an armature spacer, when a magnetic circuit is formed by a magnetic flux generated by a coil which circuit passes from the associated core in the yoke, then through to-be-attracted members and the armature spacer successively, and reaches the yoke, the magnetic flux generated by the coil is prevented from flowing directly from the core to the armature spacer without flowing through the armature, whereby it is made possible to form a satisfactory magnetic circuit which permits the magnetic flux generated by a coil to flow from the associated core to the armature spacer through the associated to-be-attracted members. Consequently, a decrease of an attracting force for attracting each armature to the associated core, which is caused by the generation of a magnetic flux, is prevented and hence it is possible to attain high printing speed and printing pressure.

16 Claims, 12 Drawing Sheets

IMPACT DOT PRINT HEAD AND A PRINTER INCLUDING THE SAME

BACKGROUND OF THE INVENTION

Field of the Invention

The present invention relates to an impact dot print head included in a printer and more particularly to an impact dot print head wherein an armature which is disposed so as to be pivotable about a pivot shaft and between a printing position and a stand-by position is actuated with a magnetic flux which is generated by energizing a coil wound round a core opposed to the armature, to effect printing, as well as a printer using the impact dot print head.

DESCRIPTION OF BACKGROUND ART

Heretofore there has been known an impact dot print head wherein an armature with a printing wire connected thereto is pivoted between a printing position and a stand-by position, and when the armature is pivoted to the printing position, a tip of the wire is brought into collision with recording paper to effect printing.

In a certain impact print head of this type, a magnetic circuit is formed around the armature to be pivoted, the magnetic circuit causing the armature to be attracted from a stand-by position to a printing position with a magnetic flux generated by a coil to effect printing.

For example, the magnetic circuit comprises a yoke having a core with a coil wound thereon to generate a magnetic flux, an armature spacer disposed near an armature at a position in contact with the yoke and not obstructing a pivotal motion of the armature, and the armature.

On an inner periphery side of the coil the magnetic flux generated by the coil flows from the core in one direction toward the armature, but at a position offset from the inner periphery side of the coil the magnetic flux tends to diffuse outwards. Consequently, this outwardly diffusing magnetic flux portion sometimes flows from the core to the armature spacer directly without through the armature. Once there occurs such a magnetic flux as flows from the core directly to the armature spacer without flowing through the armature, i.e., so-called leakage flux, the attractive force acting to attract the armature to the core is diminished.

Recently, various countermeasures have been taken to increase the printing speed and printing pressure, but due to a decrease of the attracting force caused by the generation of the aforementioned leakage flux it is difficult to fully attain the speed-up of printing speed and an increase of the printing pressure.

SUMMARY OF THE INVENTION

Accordingly, it is an object of the present invention to prevent an armature attracting force for a core from being decreased by the generation of leakage flux.

It is another object of the present invention to increase the printing speed and printing pressure.

The above objects of the present invention are achieved by novel an impact print head and a printer including the same according to the present invention.

In one aspect of the present invention there is used an armature spacer having side yoke portions, the side yoke portions each extending in a direction away from a core and confronting an armature, thereby suppressing a direct flow of a coil-generated magnetic flux from the core to the armature spacer without through the armature and allowing the coil-generated magnetic flux to flow from the core to the armature spacer through the armature, to form a satisfactory magnetic circuit from a core of a yoke up to the yoke successively through the armature and the armature spacer and thereby preventing an armature attracting force for the core from being decreased by the generation of leakage flux.

In another aspect of the present invention there is used an armature spacer having side yoke portions, the side yoke portions each extending in a direction away from a core and confronting an armature, thereby suppressing a direct flow of a coil-generated magnetic flux from the core to the armature spacer without through the armature and allowing the coil-generated magnetic flux to flow from the core to the armature spacer through the armature, to form a satisfactory magnetic circuit from a core of a yoke up to the yoke successively through the armature and the armature spacer, thereby preventing an armature attracting force for the core from being decreased by the generation of leakage flux, to increase the printing speed and printing pressure.

BRIEF DESCRIPTION OF THE DRAWINGS

A more complete understanding of the present invention and of many advantages of the invention will be obtained as the invention is better understood by reference to the following detailed description when the same is considered in connection with the accompanying drawings, in which.

DETAILED DESCRIPTION OF THE PREFERRED EMBODIMENTS

Figure 1:
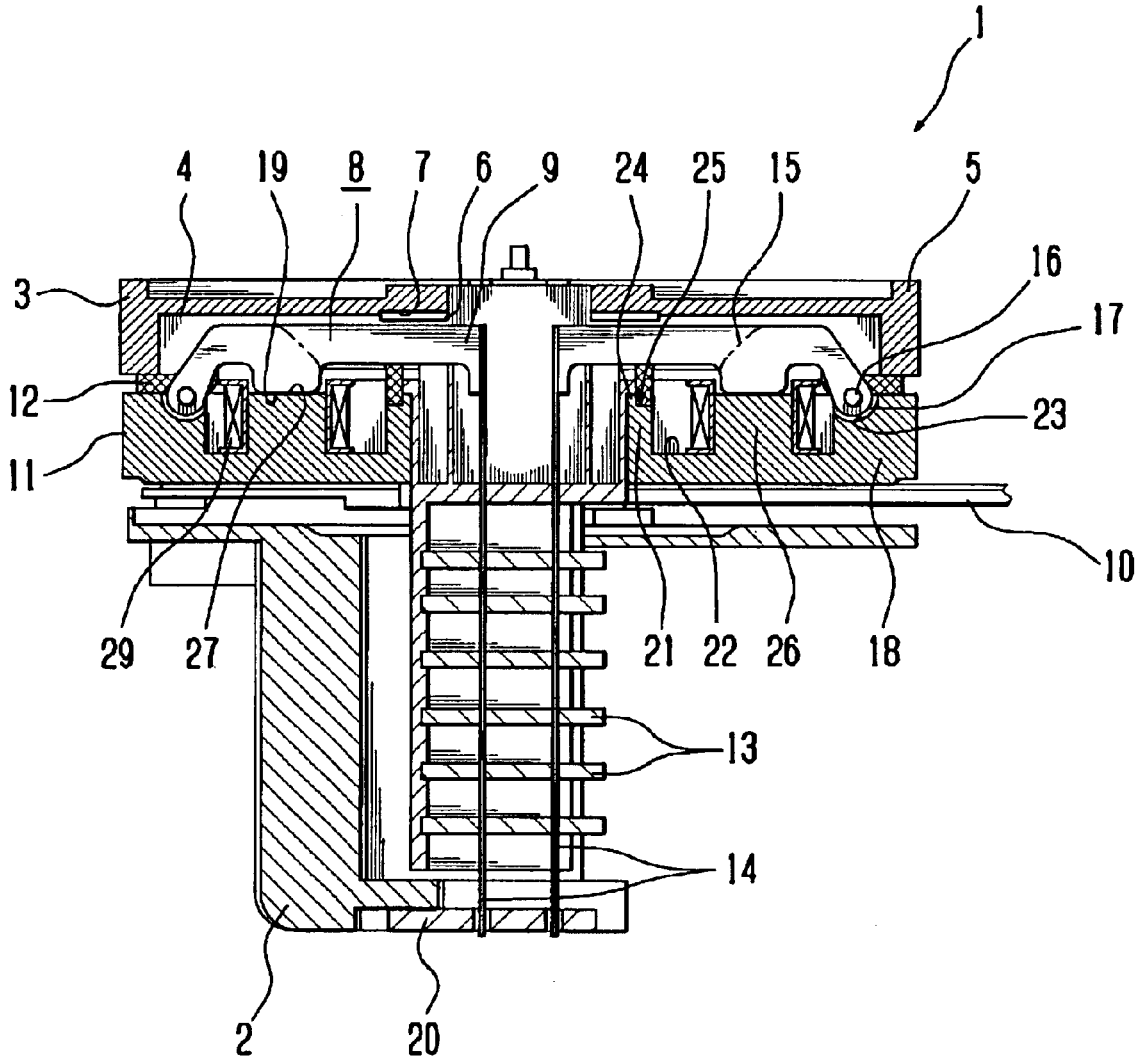
FIG. 1 is a sectional side view showing an entire construction of an impact dot print head according to the present invention.
Figure 2:
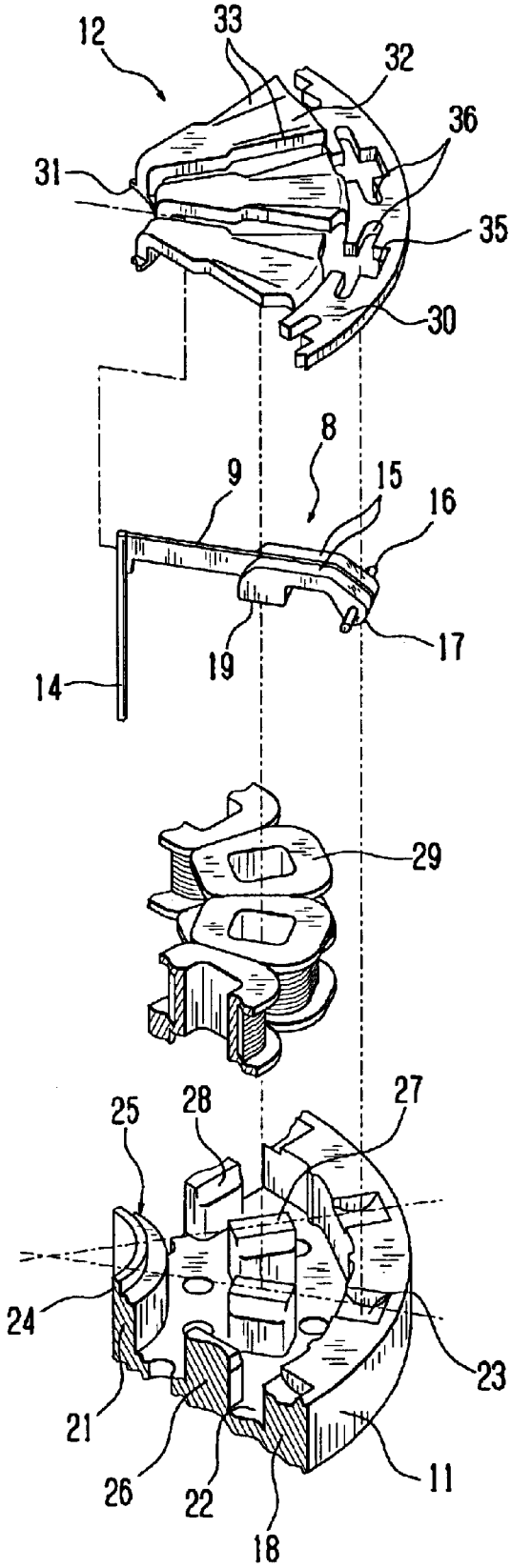
FIG. 2 is an exploded perspective view showing a part of the impact dot print head according to the invention.

An embodiment of the present invention will be described below with reference to FIGS. 1 and 2.

First, a description will be given about an entire construction of an impact dot print head according to the present invention. FIG. 1 is a sectional side view showing an entire construction of an impact dot print head according to the present invention and FIG. 2 is an exploded perspective view showing a part thereof. The impact dot print head, indicated at 1, is provided with a front case 2 and a rear case 3 which are coupled together with mounting screws (not shown).

The rear case 3 has a cylindrical portion 5 which has a bottom 4 on one end side thereof. Centrally of the bottom 4 is formed a mounting recess 7 for mounting therein of a metallic, annular armature stopper 6.

The armature stopper 6 is mounted by being fitted in the mounting recess 7. When an armature 8 to be described later pivots from a printing position to a stand-by position, an arm 9 which is a part of the armature 8 comes into abutment against the armature stopper 6. Thus, the armature stopper 6 possesses a function of defining the stand-by position of the armature 8.

Between the front case 2 and the rear case 3 there are disposed not only armatures 8 but also a circuit board 10, a yoke 11, an armature spacer 12, and wire guides 13.

The armatures 8 are each provided with an arm 9, a printing wire (hereinafter referred to simply as "wire") which is soldered to one longitudinal end of the arm 9, magnetic circuit forming members 15 welded respectively to both transverse side faces of the arm 9, and a pivot shaft 16. Bearing portions 36 to be described later and the pivot shafts 16 are fixed. The pivot shafts 16 and the armatures 8 are pivotable. Arcuate portion 17 is formed on an opposite end side of each armature 8. Plural armatures 8 are arranged radially with respect to the axis of the yoke 11. The armatures 8 are supported by a cylindrical portion 18 to be described later formed on an outer periphery side of the yoke such that each armature 8 is pivotable about the pivot shaft 16 thereof in a direction away from the yoke 11. With an urging member (not shown), the armatures 8 are each urged in the direction away from the yoke 11.

In the following description of this embodiment, a virtual plane formed by pivotal motion of each armature 8 is assumed to be a pivotal plane.

Each magnetic circuit forming member 15 has a to-be-attracted face 19. The to-be-attracted face 19 is positioned at a longitudinally central portion of each armature 8 so as to pivot with pivotal motion of the armature.

In the case where the impact dot print head 1 is mounted on a printer 51 (see FIG. 7) which will be described later, and when an armature 8 pivots to the printing position, a tip portion of the associated wire 14 moves with the pivotal motion of the armature up to a position where it strikes against a recording medium such as recording paper.

The wire guides 13 guide the wire 14 slidably so that the wire tip strikes against a predetermined position of the recording medium.

At a position near the tips of wires 14 in the front case 2 there is provided a tip guide 20 for arranging the wire tips in order along a predetermined pattern and for guiding the wires 14 slidably.

The circuit board 10 is provided with a circuit for controlling the pivotal motion of each armature 8 between the printing position and the stand-by position. In a printing operation to be described later, any armature 8 can be pivoted selectively under control made by the circuit board 10.

Figure 3:
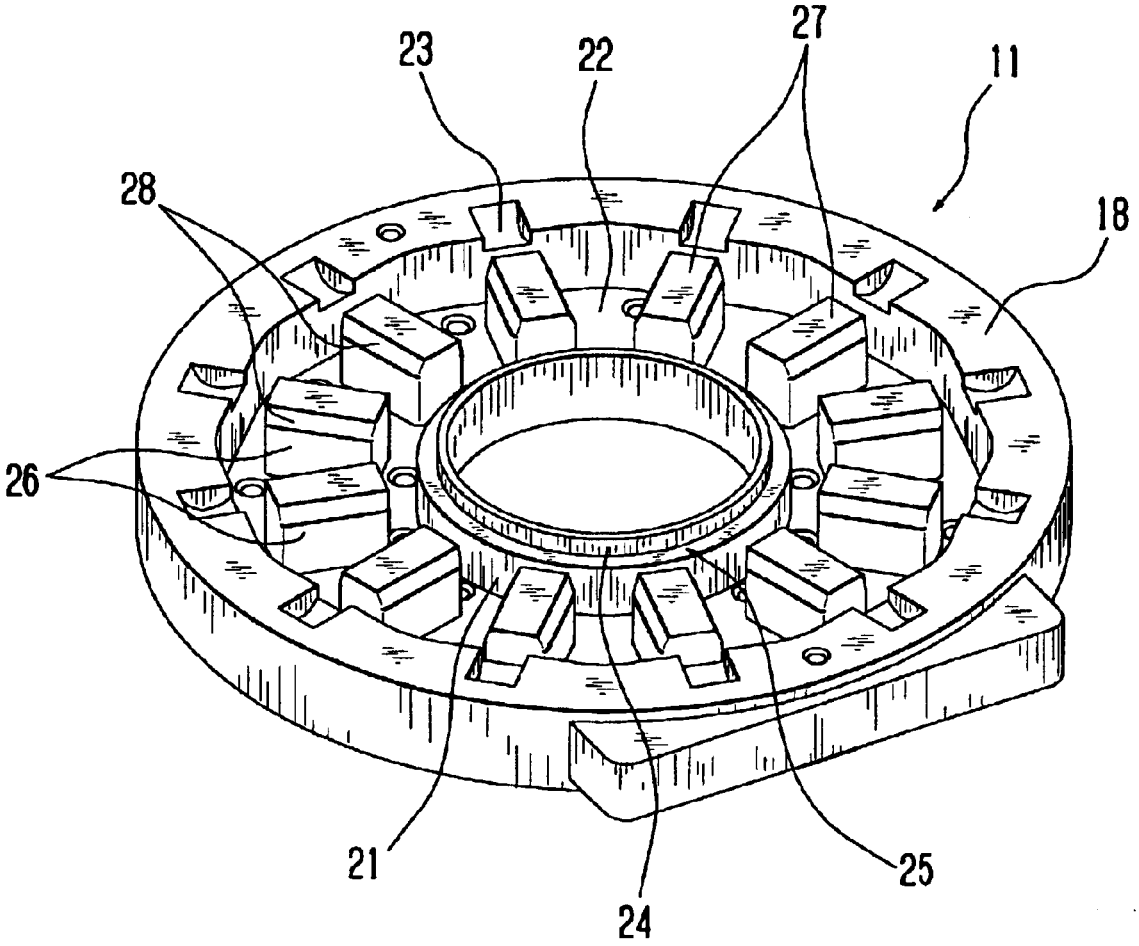
FIG. 3 is a perspective view showing a yoke according to the present invention.

Next, the yoke 11 will be described. FIG. 3 is a perspective view of the yoke 11 according to the present invention. The yoke 11 is formed of a magnetic material and has a pair of concentric, cylindrical portions 18 and 21 of different diameters, as shown in FIG. 3. The sizes in an axial direction (the vertical direction of paper in FIG. 1) of the cylindrical portions 18 and 21, which direction will hereinafter be regarded as an axial direction of the yoke 11, are set equal to each other. The cylindrical portion 18 located on the outer periphery side and the cylindrical portion 21 located on the inner periphery side are united by a bottom portion 22 which is provided so as to close one end side in the axial direction.

Plural recesses 23 are formed in an end face of the outer periphery-side cylindrical portion 18 on the side opposite to the bottom portion 22. The recesses 23 have a concave shape such that an inner periphery surface of each of the recesses is formed so as to have a radius of curvature approximately equal to that of an outer periphery surface of the arcuate portion 17 of each armature. The recesses 23 are provided in the same number as the number of the armatures 6. The arcuate portion 17 formed on one end side of each armature 8 is slidably fitted in each recess 23.

A to-be-fitted portion 24 having an annular shape is provided along an end face of the inner periphery-side cylindrical portion 21 on the side opposite to the bottom portion 22. The to-be-fitted portion 24 is integral with the inner periphery-side cylindrical portion 21 so as to be positioned concentrically with the cylindrical portion 21. An outside diameter of the to-be-fitted portion 24 is set smaller than that of the inner periphery-side cylindrical portion 21. On the side opposite to the bottom portion 21 of the inner periphery-side cylindrical portion 21 there is formed a stepped portion 25 by both to-be-fitted portion 24 and cylindrical portion 21.

Plural cores 26 are integrally provided on the bottom portion 22 and between the outer periphery-side cylindrical portion 18 and the inner periphery-side cylindrical portion 21 so as to be arranged annularly on a circumference concentric with the cylindrical portions 18 and 21. The size of each core 26 in the axial direction of the yoke 11 is set equal to the size of each of the cylindrical portions 18 and 21 in the same direction.

A pole face 27 is formed on one end of each core 26 in the axial direction of the yoke 11. The pole faces 27 of the cores 26 are provided so as to be opposed to the to-be-attracted faces 19 of the magnetic circuit forming members 15 in the armatures 8.

On both end sides of each core 26 in the radial direction of the yoke 11 are formed slant faces 28 which are inclined from the associated pole face 27 toward the bottom portion 22 along a line of intersection between the pole face 27 and the pivotal plane of the associated armature 8.

Coils 29 are fitted respectively on outer peripheries of the cores 26. In this embodiment, all the coils 29 are wound in the same direction, provided this constitutes no limitation. Coils different in the winding direction may be arranged selectively.

In this embodiment, by a space present between each slant face 28 and the associated coil 29 there is formed a chamfered portion 50 (see FIG. 6) along a line of intersection between the pole face 27 and the pivotal plane at a position spaced to a further extent from the associated one of guide portions 32 to be described later of the armature spacer 12 than the pole face 27.

The yoke 11 is held between the front case 2 and the rear case 3 in a state in which its open side opposite to the bottom portion 22 is opposed to an open, opposite end side of the rear case 3.

Figure 4:
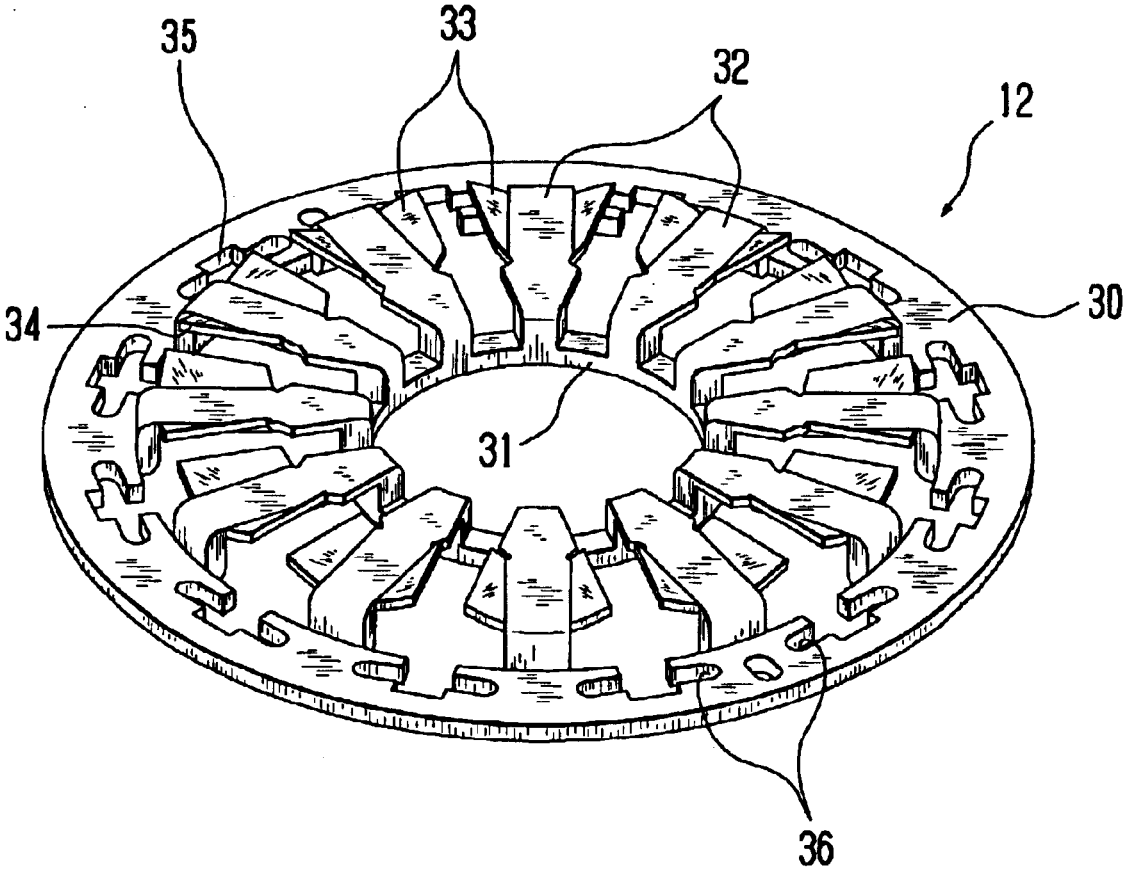
FIG. 4 is a perspective view showing an armature spacer according to the present invention.

A description will now be given of the armature spacer 12. FIG. 4 is a perspective view of the armature spacer 12 according to the present invention. As shown in the same figure, the armature spacer 12 has a pair of ring-shaped portions 30 and 31 almost equal in diameter to the cylindrical portions 18 and 21, respectively, of the yoke 11 and plural guide portions 32 which span radially between the pair of ring-shaped portions 30 and 31 so as to be each positioned between adjacent armatures 8. The ring-shaped portion 30 located on an outer periphery side and the ring-shaped portion 31 located on an inner periphery side are concentric with each other. The outer and inner periphery-side ring-shaped portions 30, 31 and the guide portions 32 are integrally formed by molding. In this embodiment, the outer and inner periphery-side ring-shaped portions 30, 31 come into abutment against the cylindrical portions 18 and 21, respectively, of the yoke 11 and therefore abutment portions are realized by abutment positions of both ring-shaped portions 30, 31 against the cylindrical portions 18 and 21.

An inside diameter of the inner periphery-side ring-shaped portion 31 is set equal to or a little larger than an outside diameter of the to-be-fitted portion 24.

Each guide portion 32 is provided with side yoke portions 33 which extend substantially radially of the ring-shaped portions 30 and 31 and in an oblique direction away from the pole face 27 of each core 26. The side yoke portions 33 are each in the shape of a vane which is wider toward the outer periphery-side ring-shaped portion 30 from the inner periphery-side ring-shaped portion 31.

Figure 5:
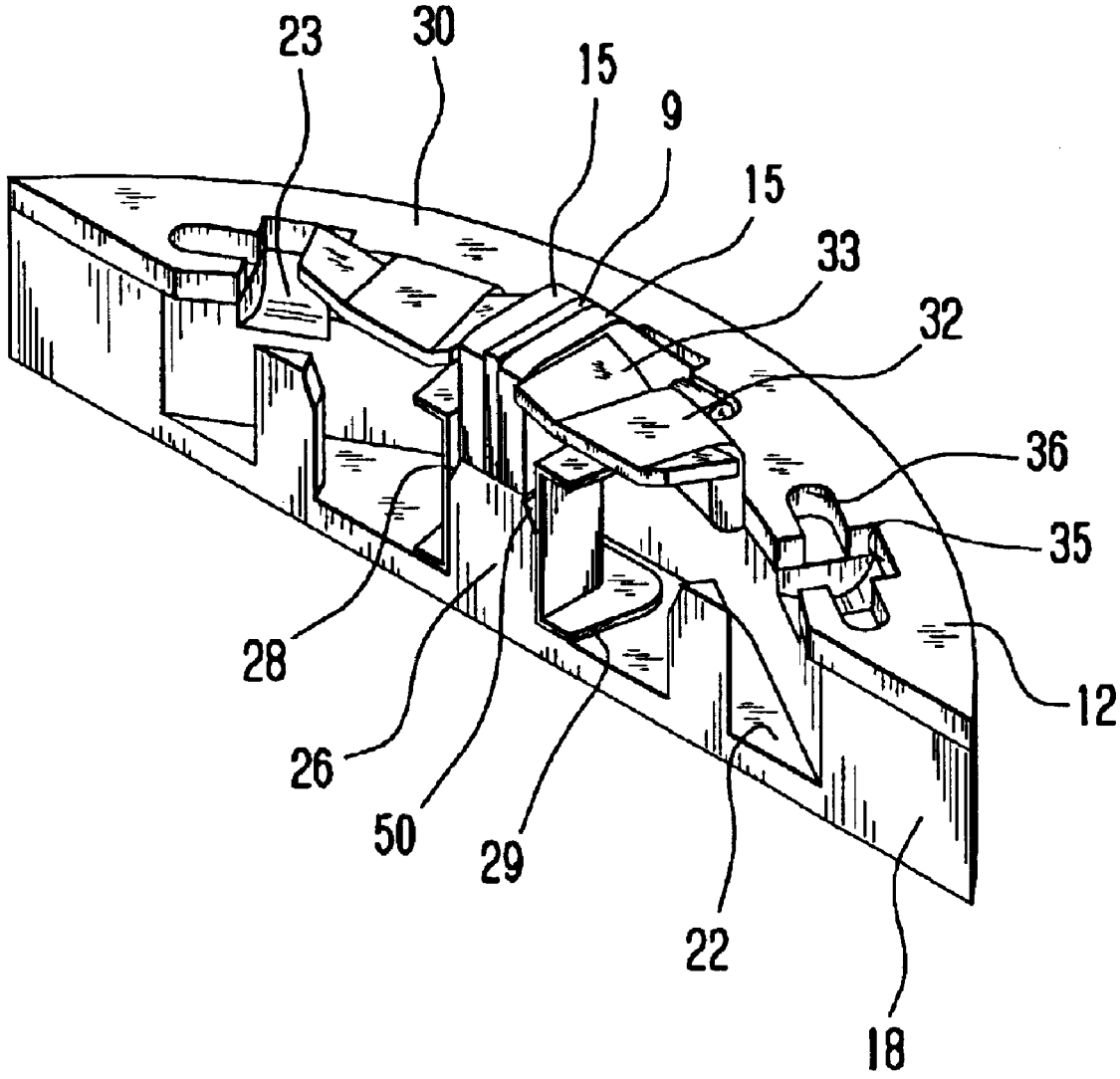
FIG. 5 is a sectional perspective view showing a section of the impact dot print head according to the present invention taken in an axial direction of the yoke so as to pass through at least one coil.

FIG. 5 is a sectional perspective view of the impact dot print head 1 according to the present invention which is taken in the axial direction of the yoke 11 so as to pass through at least one coil 29. As is seen from FIG. 5, the core 26-side face of each side yoke portion 33 extend inclinedly in a direction away from the core 26 and confronts the associated armature 8.

In each side yoke portion 33 it is preferable that the distance between the pole face 27 of the associated core 26 and the to-be-attracted face 19 of the associated magnetic circuit forming member 15 be set smaller than the distance between the position where a magnetic flux begins to diffuse to the exterior away from an inner periphery-side position of the associated coil 29 and the armature spacer 12.

The side yoke portion 33 has an opposite face 34 which is just in opposition to the magnetic circuit forming member in a direction orthogonal to the pivotal plane of the armature 8.

In the armature spacer 12, a guide slit 35 which is open in the radial direction of the ring-shaped portions 30 and 31 is ensured between adjacent side yoke portions, i.e., between a side yoke portion 33 of a certain guide portion 32 and a side yoke portion 33 of a guide portion 32 adjacent thereto. The width of each guide slit 35 is set such that the opposite face 34 of each side yoke portion is opposed to the associated magnetic circuit forming member 15 to such an extent as does not obstruct the pivotal motion of the armature 8.

The guide slits 35 communicate with the outer periphery-side ring-shaped portion 30 and in each guide slit 35 in the ring-shaped portion 30 are formed bearing slits 36 at both side positions of the guide slit 35 in an outside diameter direction of the ring-shaped portion 30, the bearing slits 36 being open contiguously to the guide slit 35. The pivot shaft 16 of each armature 8 is fitted in the bearing slits 36.

The armature spacer 12 in this embodiment is formed by pressing sheet metal. As to the press working for sheet metal, a drawing and explanation thereof are here omitted because it is a known technique, but in fabricating the armature spacer 12 by pressing sheet metal, the sheet metal is subjected to punching in the positions of guide slits 35 and bearing slits 36 and the guide portions 32 are curved in a predetermined shape in the punching direction. As a result, the opposed faces 34 of the side yoke portions 33 become pressed end faces.

Particularly, the side yoke portions 33 in this embodiment are pressed so as to be inclined at an angle of not larger than 45° in the sheet surface direction of the sheet metal (in the surface direction of the ring-shaped portion).

By thus inclining the side yoke portions 33 at an angle of below 45° in the surface direction of the sheet metal at the time of forming the armature spacer 12 by pressing the sheet metal, the area of the opposed face 34 is larger than that of a pressed end face obtained by pressing the sheet metal in the sheet thickness direction without going through any special process. In case of adopting a pressing work for the fabrication of the armature spacer 12, the area of the opposed face 34 becomes largest when the side yoke portions 33 are inclined at an angle of 45° in the surface direction of the sheet metal.

Figure 6:
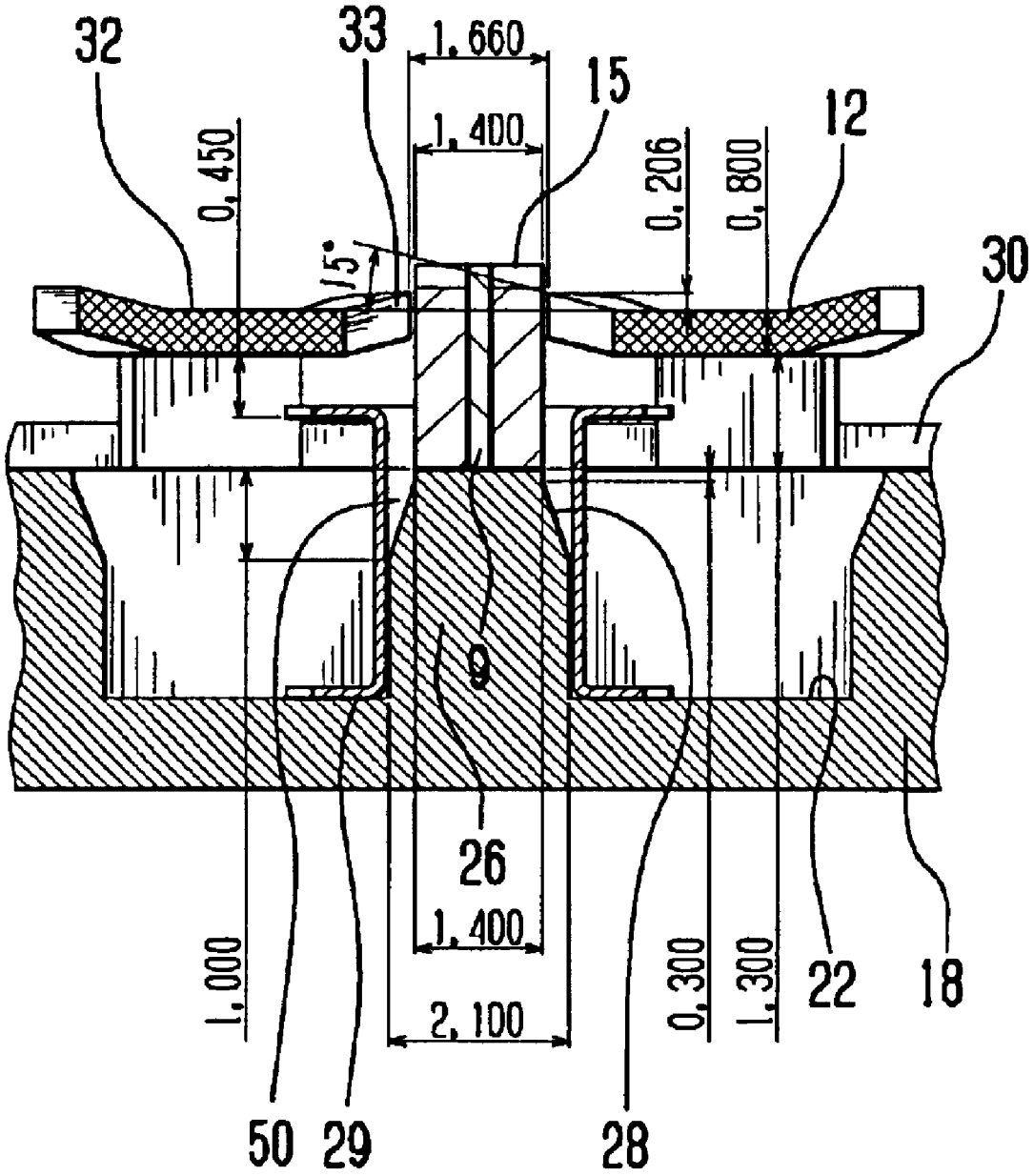
FIG. 6 is a sectional view showing a section of the impact dot print head according to the present invention taken in the axial direction of the yoke so as to pass through at least one yoke.

FIG. 6 is a sectional view of the impact dot print head 1 according to the present invention which is taken in the axial direction of the yoke 11 so as to pass at least one coil 29. In FIG. 6 there are shown, as an example, side yoke portions 33 which are inclined at angle of 15° in the sheet surface direction of the armature spacer 12. In FIG. 6 there are also shown, as an example, chamfered portions 28 in a core of the yoke 11, as well as the spacing between each magnetic circuit forming member 15 and the opposed face 34. The sizes of various portions in the impact dot print head 34 are not limited to those shown in FIG. 6.

The following description is now provided about a printer using the impact dot print head 1 constructed as above.

Figure 7:
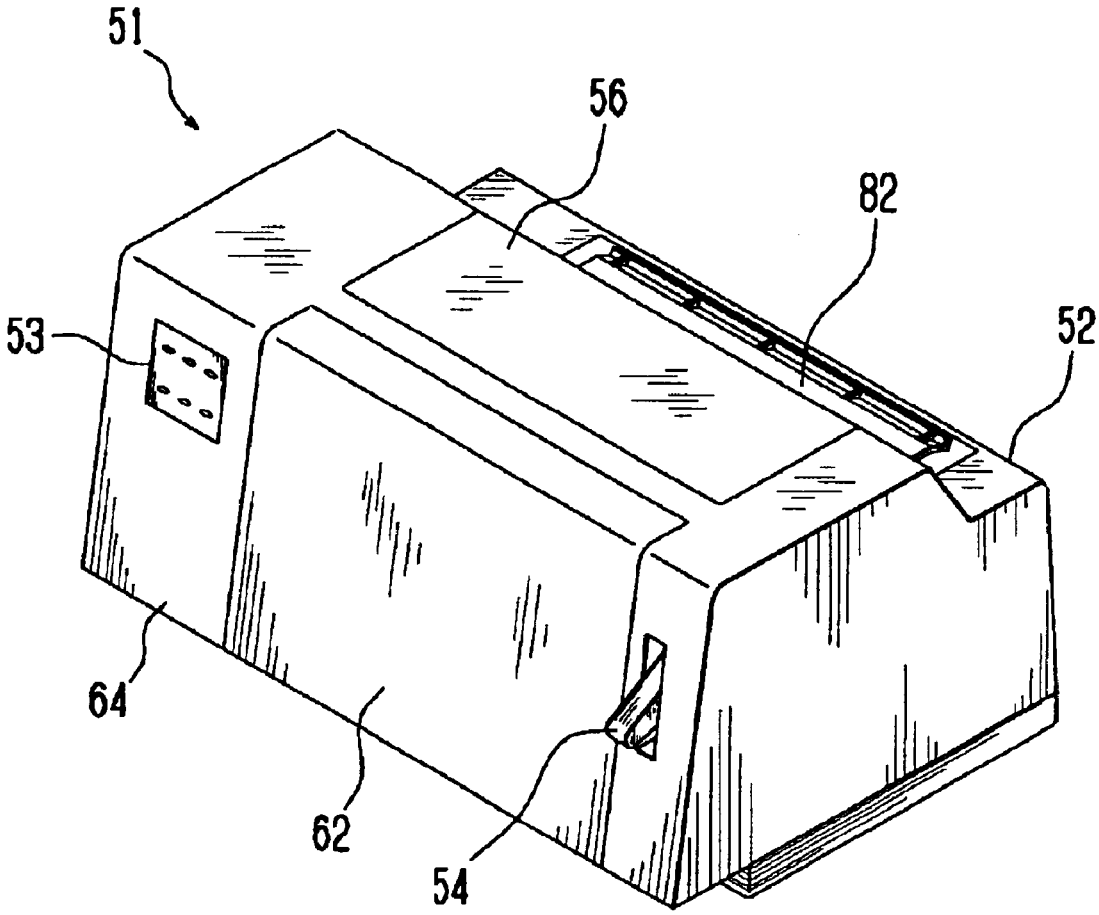
FIG. 7 is a perspective view showing a printer according to the present invention.
Figure 8:
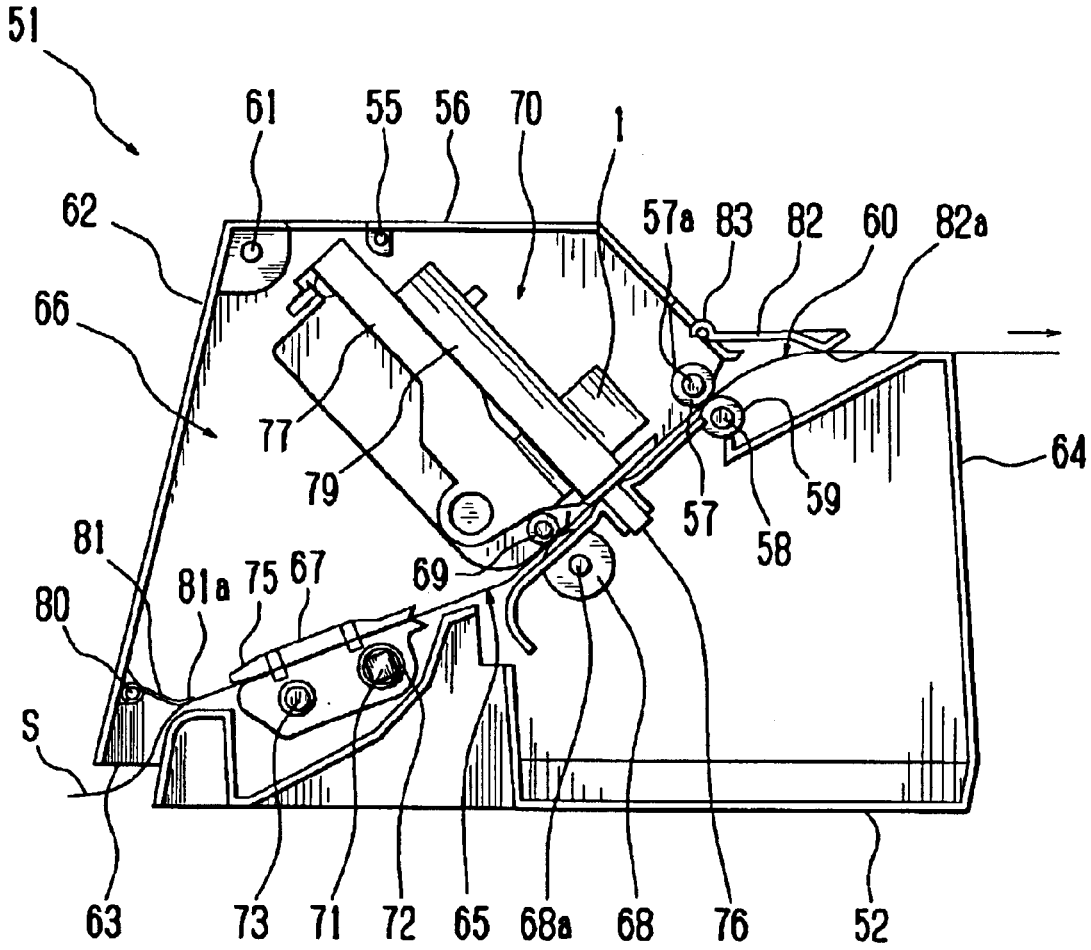
FIG. 8 is a side view in vertical section, showing an outline of a printer according to the present invention.

FIG. 7 is a perspective view of the printer and FIG. 8 is a side view in vertical section showing the printer schematically. In this embodiment, a wire dot printer is shown as an example of the printer 51. In the printer embodying the present invention, which is indicated at 51, band-like continuous paper S is used as a recording medium. The paper S has plural holes which are formed intermittently on both sides in the transverse direction of the paper.

In a casing 52 of the printer 51 is provided an operating panel 53 having various operating keys on the front left side and a power switch 54 on the front right side.

On an upper surface side of the casing 52 is provided a ribbon change cover 56 which is pivotable in a direction (upward) away from the casing 52 about a pivot shaft 55 which is provided on an upper side of the printer 51. The ribbon change cover 56 is provided with a pinch roller 57 which is pivotable about a pivot shaft 57*a*. A feed roller 59 which is pivotable about a pivot shaft 58 is in abutment against the pinch roller 57. In this embodiment, a downstream side of a nip portion between the pinch roller 57 and the feed roller 59 defines a paper discharge port 60.

Centrally of a front side of the casing 52 is provided a top cover 62 which is pivotable about a pivot shaft 61 in a direction (upward) away from the casing 52. The pivot shaft 61 is disposed on an upper side in the interior of the casing 52. A paper suction port 63 is defined by the casing 52 and the top cover 62 on a front lower side of the printer 51 in a closed state of the top cover 62.

In this embodiment, a housing 64 is formed by the casing 52, top cover 62 and ribbon change cover 56. Within the housing 64 is formed a paper guide passage 65 which is in communication at one end thereof with the paper suction port 63 and at an opposite end thereof with the paper discharge port 60 to guide the continuous paper S as a recording medium along a predetermined path. While the continuous paper S is guided through the paper guide passage 65, a space 66 is defined by an upper portion of the housing 64 and the paper guide passage 65. In the printer 51 of this embodiment, the continuous paper S is conveyed in the direction indicated with arrow in FIG. 8.

In the paper guide passage 65 there are provided tractors 67 for conveying the continuous paper S being guided through the paper guide passage 65 toward the paper discharge port 60 from the paper suction port 63, a feed roller 68 which is rotatable with a rotary shaft 68*a* as a rotational center, the rotary shaft 68*a* being rotated by means of a motor (not shown), a pinch roller 69 which is abutted against the feed roller 68 through the paper guide passage 65, and a printer unit 70 for printing a predetermined matter onto the continuous paper S on the paper guide passage 65. The feed rollers 59 and 68 are each rotated by means of a motor (not shown) to convey the continuous paper S which is pinched between those feed rollers and the pinch rollers 57 and 69. In this embodiment, the tractors 67 are disposed respectively at both end portions in the transverse direction of the paper guide passage 65. In this embodiment, a paper conveying mechanism is constituted by the tractors 67 and feed rollers 59 and 68.

Although a detailed description will here be omitted because of a known technique, the tractors 67 are provided with a drive roller 72 adapted to rotate about a square shaft 71 which is rotated by means of a motor (not shown), a guide member (not shown) provided movably on a guide shaft 73 parallel to the drive roller 72, and a belt (not shown) entrained on both driver roller 72 and guide member and having projections (not shown) projecting toward the outer periphery side. The tractors 67 are disposed in such a manner that the moving direction of the continuous paper S conveyed by the belt is parallel to the longitudinal direction of the paper guide passage 65.

The tractor 67 is further provided with a paper presser 75 having plural holes (not shown) in positions opposed to the projections of the belt. The paper presser 75 is disposed so as to be opposed to the belt through the continuous paper S which is guided through the paper guide passage 65. The paper presser 75 is pivotable in a direction (upward of paper in FIG. 7) away from the belt with a connection 75*a* as a fulcrum which connection 75*a* is formed on one end side of the paper guide passage 65. The tractors 67 are provided with a spring for urging the paper presser 75 toward the belt, whereby the holes formed in the continuous paper S are prevented from coming off the projections on the belt during conveyance of the continuous paper S.

The printer unit 70 comprises a platen 76 disposed in the paper guide passage 65, a carriage 77 capable of reciprocating along the plate in directions orthogonal to the paper guide passage 65, the impact dot print head 1 described above which is mounted on the carriage 77, and an ink ribbon cartridge 79. The carriage 77 is driven by means of a motor (not shown) and is reciprocated along the platen 76. As the carriage 77 reciprocates along the platen 76, the impact dot print head 1 is reciprocated in the horizontal scanning direction. Thus, in this embodiment, a head drive mechanism is constituted by the carriage 77 and the motor.

The impact dot print head 1 is disposed so that the tip of each wire 14 is opposed to the platen 76. In the printer unit 70, plural coils 29 are energized selectively, whereby the tips of wires 14 are brought into the printing position through an in ribbon (not shown) in the ink ribbon cartridge 79 to print a predetermined matter onto the continuous paper S.

In the interior of the housing 64 a pivot shaft 80 is provided above the paper guide passage 65 on the back side of the top cover 62, the pivot shaft 80 extending in a direction orthogonal to the paper guide passage 65. A sound insulating member 81 having a free end 81*a* not fixed on one end side is pivotably mounted at an opposite end thereof onto the pivot shaft 80.

With the top cover 62 closed, the free end 81*a* of the sound insulating member 81 is urged in a direction (downward) away from the top cover 62 by virtue of its own weight and assumes a position in which it interferes with the paper guide passage 65 from above. Therefore, while the continuous paper S is conducted through the paper guide passage 65, the free end 81*a* of the sound insulating member 81 interferes with (contacts) the continuous paper S.

A sound insulating member 82 has a free end 82*a* not fixed on one end side and an opposite end thereof is mounted on the back side of the printer 51 and in the vicinity of the pinch roller 57 pivotably through a hinge 83.

With a straight extension line passing through the center of the hinge 83 as a boundary line, if the free end 82*a* of the sound insulating member 82 is at a position deviated from the boundary line, the sound insulating member 82 is urged pivotally toward either the ribbon change cover 56 or the casing 52 by virtue of its own weight. Usually, the sound insulating member 82 is urged and hangs down toward the casing 52 with respect to the boundary line by virtue of its own weight and its free end 82*a* is positioned lower than the pivot shaft 55. The pressure which the free end 82*a* of the sound insulating member 82 applies to the continuous paper S depends on the mass of the sound insulating member 82, but it is such a degree of pressure as permits the free end 82*a* to be pushed back by the stiffness of the continuous paper S.

With the continuous paper S not discharged from the paper discharge port 60, the sound insulating member 82 lies at a position at which its pivotal motion is inhibited by its contact with a portion of the ribbon change cover 56 located below the hinge 83.

On the other hand, while the continuous paper S is being discharged from the paper discharge port 60, the free end 82*a* of the sound insulating member 82 abuts the continuous paper S while being pushed back toward the paper although the position of the free end 82*a* differs depending on the type and thickness of the continuous paper S. For example, in case of conveying continuous paper which is thicker or more stiff than the continuous paper S shown in FIG. 8, the free end 82*a* of the sound insulating member 82 assumes a position higher than that shown in FIG. 8. Conversely, in case of conveying thinner or less stiff paper than the continuous paper S shown in FIG. 8, the paper discharged from the paper discharge port 60 hangs down, so that the free end 82*a* of the sound insulating member 82 moves still downward by its own weight and assumes a lower position than that shown in FIG. 8.

The material for forming the sound insulating members 81 and 82 is not specially limited insofar as it can retain a predetermined shape.

Though not shown, the printer 51 incorporates a control unit for controlling various components installed within the housing 64, including the printer unit 70 and the motor.

When a certain coil 29 is energized through the control unit in a printing operation by the printer 51, there is formed a magnetic circuit among the core 26 on which the coil 29 is mounted, the magnetic circuit forming members 15 of the armature opposed to the core 26, the pair of side yoke portions 33 opposed to the magnetic circuit forming members 15, the outer and inner periphery-side cylindrical portions 18, 21, the bottom portion 22, and again the core 26. As a result of formation of this magnetic circuit there occurs an attractive force between the to-be-attracted faces 19 of the magnetic circuit forming members 15 and the pole face 27 of the core 26 which attractive force acts to pull the magnetic circuit forming members 15 toward the pole face 27 of the core 26. With this attractive force, the armature 8 pivots about the pivot shaft 16 in a direction in which the to-be-attracted faces 19 of the magnetic circuit forming members 15 are attracted to the pole face 27 of the core 26.

In this embodiment, the position at which the to-be-attracted faces 19 of the magnetic circuit forming members 15 of each armature 8 pivotable about its pivot shaft 16 comes into abutment against the pole face 27 of the associated core 26 is assumed to be the printing position (see FIG. 1) and the position at which the to-be-attracted faces 19 move away from the pole face 27 is assumed to be a stand-by position.

As the armature 8 pivots to the printing position, the tip of the associated wire 14 projects to the recording paper side. In this embodiment, since an ink ribbon is interposed between the impact dot print head 1 and the continuous paper S, the pressure of the wire 14 is transmitted through the ink ribbon to the recording medium and the ink contained in the ink ribbon is transferred to the paper S, whereby printing is effected. A printing control means is here implemented.

Although in this embodiment the continuous paper S is used as a recording medium, no limitation is made thereto. For example, there may be used pressure-sensitive color developing recording paper (pressure-sensitive color developing paper) as the recording medium which paper develops color at a pressurized portion upon application of pressure thereto.

In case of using pressure-sensitive color developing recording paper (pressure-sensitive color developing paper) as the recording medium, a portion of the paper is pressurized with the pressure of wire 14 in the impact dot print head 1 and the pressurized portion develops color to effect printing. A printing control means is here implemented.

When the coil 29 is de-energized, the magnetic flux so far generated becomes extinct, so that the magnetic circuit also vanishes. Consequently, the attractive force for attracting the magnetic circuit forming members 15 to the pole face 27 of the associated core 26 disappears, so that the armature 8 is urged away from the yoke 11 with an urging force of an urging member (not shown) and pivots about its pivot shaft toward the stand-by position. The armature 8 pivots toward the stand-by position until its arm 9 comes into abutment against the armature stopper 6, whereupon the armature is stopped at the stand-by position.

Next, a description will be given of the magnetic circuit which is formed upon energization of each coil 29. As described above, when the coil 29 opposed to the armature 8 to be pivoted is energized, there is formed a magnetic circuit such that a magnetic flux generated is transmitted from the core 26 with the coil 29 wound thereon to the magnetic circuit forming members 15 of the opposed armature 8, then flows to the yoke 11 through the armature spacer 12 and the cylindrical portions 18 and 21 located around the core 26 of the energized coil, and again reaches the core 26 with the energized coil 29 wound thereon.

With the magnetic flux flow in this magnetic circuit, an attractive force for attracting the to-be-attracted faces 19 of the magnetic circuit forming members 15 in the armature 8 toward the pole face 27 of the core 26 is developed between the pole face 27 and the to-be-attracted faces 19.

The magnetic flux generated by energizing the coil 29 flows toward an inner periphery side of the coil 29, that is, in the core 26 portion, it flows in one direction from the core 26 toward the armature 8, but if the flow deviates from the inner periphery portion of the coil, it tends to diffuse outward from the deviated position.

Figure 9:
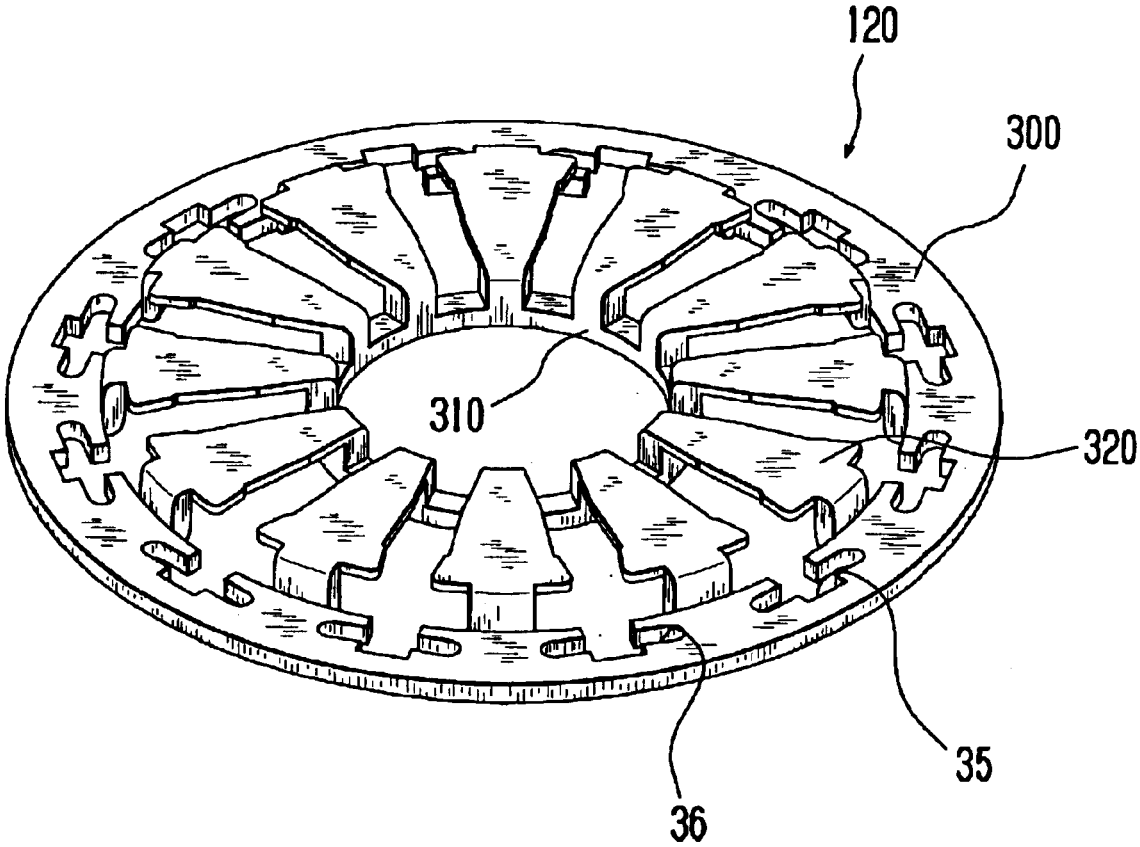
FIG. 9 is a perspective view showing an armature spacer used in a conventional impact print head.
Figure 10:
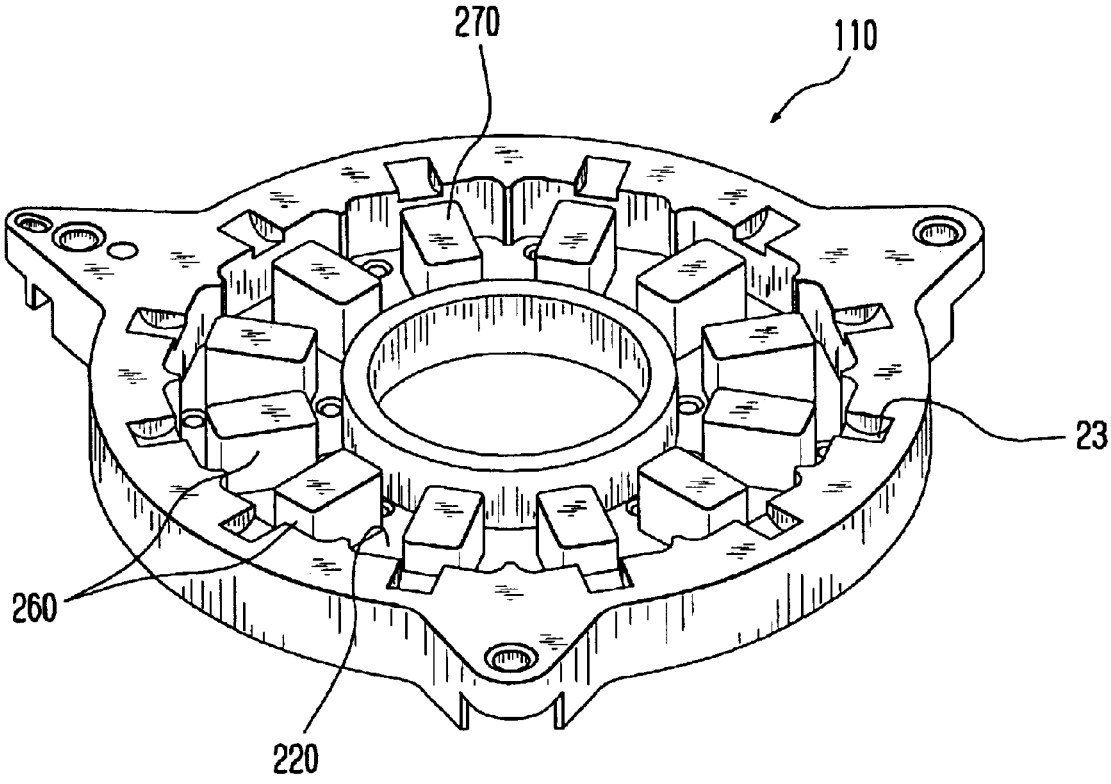
FIG. 10 is a perspective view showing a yoke of the conventional impact print head.

FIG. 9 is a perspective view showing an armature spacer 120 provided in a conventional impact print head 100 and FIG. 10 is a perspective view showing a yoke 110 used in the conventional impact print head 100. As is seen from FIG. 9, the armature spacer 120 used in the conventional impact print head 100 is also provided with ring-shaped portions 300, 310 and plural guide portions 320, but the guide portions 320 used in the conventional armature spacer 120 are parallel to a bottom portion 220 of the yoke 110.

Figure 11:
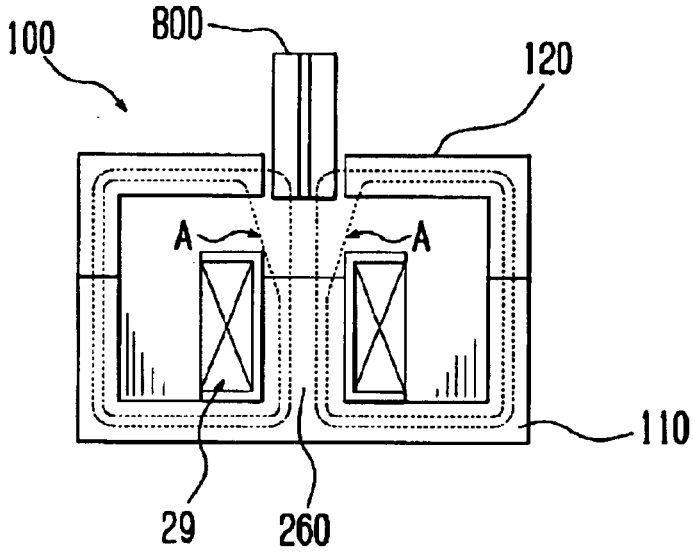
FIG. 11 is an explanatory diagram showing schematically a state in which a magnetic circuit formed by a single coil in the conventional impact print head and portions related to the formation of the magnetic circuit are seen in a direction orthogonal to the radial direction of the yoke.

Therefore, in the conventional impact print head 100, as shown in FIG. 11, there sometimes occurs a case where a magnetic flux deviated from an inner periphery portion of a coil 29 flows from a core 260 directly to the armature spacer 120 without going through an armature 800 (see arrow A in FIG. 11).

Further, as is seen from FIG. 10, in the yoke 110 used in the conventional impact print head 100, pole faces 270 of the cores 260 are uniformly opposed in parallel to the armatures 800.

With this construction, the distance between a position at which a magnetic flux deviates from an inner periphery position of a coil 29 and begins to diffuse outwards: and the armature spacer 120 is smaller than the distance between the pole face 270 of the associated core 260 and a to-be-attracted face 190 in the associated armature 800, with the result that, as indicated with arrow A in FIG. 11, a magnetic flux which tends to diffuse outwards from a position deviated from the inner periphery position of the coil 29 becomes easier to flow from the core 260 to the armature spacer 120 without flowing through the armature 800.

In the conventional impact print head 100, as indicated with arrow A in FIG. 11, there occurs a magnetic flux, so-called leakage flux, which flows from the core 260 directly to the armature spacer 120 without flowing through the armature 800, so that the attractive force for attracting the to-be-attracted faces 190 in the armature 800 toward the pole face 270 of the core 260 is diminished.

Figure 12:
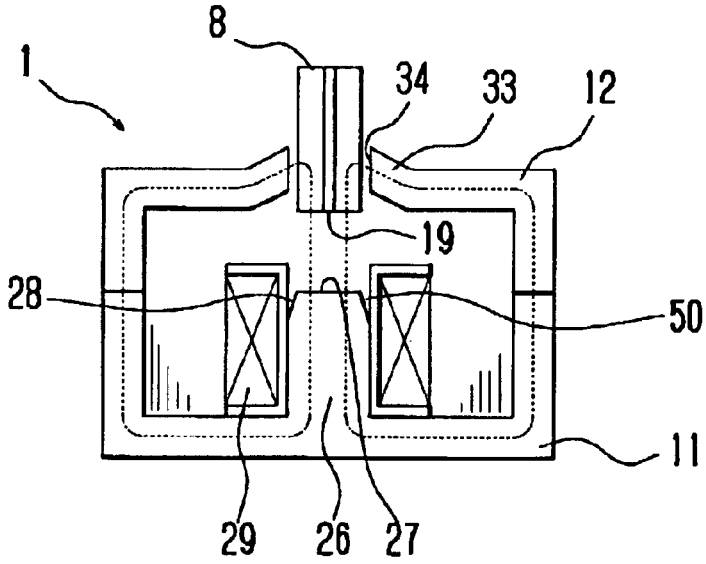
FIG. 12 is an explanatory diagram showing schematically a state in which a magnetic circuit formed by a single coil in the impact dot print head according to the present invention and portions related to the formation of the magnetic circuit are seen in a direction orthogonal to the radial direction of the yoke.

On the other hand, in this embodiment, each guide portion 32 is provided with side yoke portions 33 which are each inclined in a direction away from the pole face 27 of the associated core 26 so as to confront the associated armature 8 extending away from the core 26, so that the distance of the armature spacer 12 from the pole face 27 of the core 26 is larger than in the conventional impact print head 100. FIG. 12 is an explanatory diagram showing schematically a state in which a magnetic circuit formed by a single coil 29 in the impact dot print head 1 according to the present invention is seen in a direction orthogonal to the radial direction of the yoke 11. As noted earlier, there are provided side yoke portions 33, the side yoke portions 33 being inclined relative to the surface direction of the armature spacer 12 in such a manner that the distance between the pole face 27 of each core 26 and the to-be-attracted face 19 of each magnetic circuit forming member 15 in the associated armature 8 is smaller than the distance between a position at which a magnetic flux deviates from an inner periphery position of the associated coil 29 and begins to diffuse outwards, whereby the magnetic flux deviating from the inner periphery position of the coil 29 and tending to diffuse outwards can be prevented from flowing directly from the core 26 to the armature spacer 12 without flowing through the magnetic circuit forming members 15 of the armature 8.

Thus, the magnetic flux generated in the coil 29 can be allowed to flow efficiently from the core 26 to the armature spacer 12 through the magnetic circuit forming members 15 of the armature 8 and hence it is possible to prevent the attainment of high printing speed and high printing pressure from being restricted by a decrease of attractive force due to the generation of leakage flux.

Since in this embodiment sheet metal is pressed so that each side yoke portion 33 is inclined at an angle of not larger than 45° relative to the surface direction of the sheet metal (the surface direction of the ring-shaped portions 30 and 31), it is possible to ensure the opposite face 34 having a wide area in comparison with a section cut in parallel with the thickness direction of the sheet metal, without the necessity of going through any special process. With such a wide opposite face 34, a magnetic resistance in the armature spacer 12 can be made relatively small as compared with that in an armature spacer having opposite faces of an area obtained by cutting sheet metal in parallel with the sheet thickness direction. Consequently, it is possible to form a more satisfactory magnetic circuit.

Particularly, by pressing sheet metal so that each side yoke portion 33 in the armature spacer 12 is inclined at an angle of 45° relative to the surface direction of the sheet metal, it is possible to ensure the largest area of each opposite face 34 without going through any special process in the fabrication of the armature spacer 12 using press working.

In this embodiment, moreover, since the opposite face 34 is just in opposition to the pivotal plane of the associated armature 8 in a direction orthogonal to the pivotal plane, it is possible to let a magnetic flux flow efficiently between the armature 8 and the armature spacer 12, whereby it is possible to form a more satisfactory magnetic circuit.

Further, by forming the armature spacer 12 by pressing sheet metal, it is possible to improve the machinability and reduce the manufacturing cost.

Each core 26 is formed with chamfered portions 28 at both end positions radially of the yoke 11. The chamfered portions 28 are inclined from the pole face 27 toward the bottom portion 22, so that it is possible to ensure a larger distance of the armature spacer 12 from the pole face 27 of the core 26. Consequently, a magnetic flux deviating from an inner periphery position of the associated coil 29 and tending to diffuse to the exterior can be prevented from flowing directly from the core 26 to the armature spacer 12 without flowing through the armature 8, and the magnetic flux generated in the coil 29 can be allowed to flow efficiently from the core 26 to the armature spacer 12 through the magnetic circuit forming members 15 in the associated armature 8.

Figure 13:
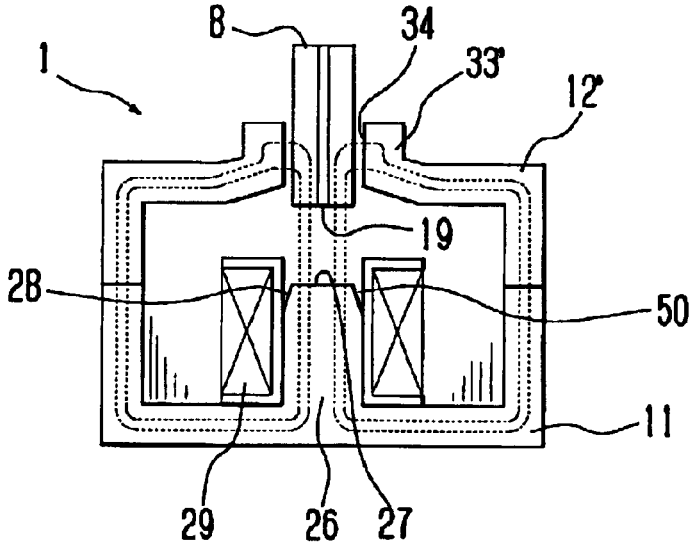
FIG. 13 is an explanatory diagram showing schematically a state in which a magnetic circuit formed by a single coil in an impact dot print head having another armature spacer according to the present invention, as well as portions related to the formation of the magnetic circuit, are seen in a direction orthogonal to the radial direction of the yoke.

FIG. 13 is an explanatory diagram showing schematically a state in which a magnetic circuit formed by a single coil 29 in an impact dot print head 1 having another armature spacer 12' according to the present invention, as well as portions related to the formation of the magnetic circuit, are seen in a direction orthogonal to the radial direction of the yoke 11. As is seen from FIG. 13, the armature spacer 12' used in this embodiment has side yoke portions 33' which are bent in two steps.

According to the armature spacer 12' having such side yoke portions 33', it is possible to ensure wide opposite faces 34 just in opposition to armatures 8, so that a magnetic flux can be allowed to flow efficiently between the magnetic circuit forming members 15 of each armature 8 and the armature spacer 12'.

Moreover, since the armature spacer 12' having such side yoke portions 33 can be fabricated by pressing sheet metal, the armature spacer 12' also contributes to the reduction of the manufacturing cost.

Figure 14:
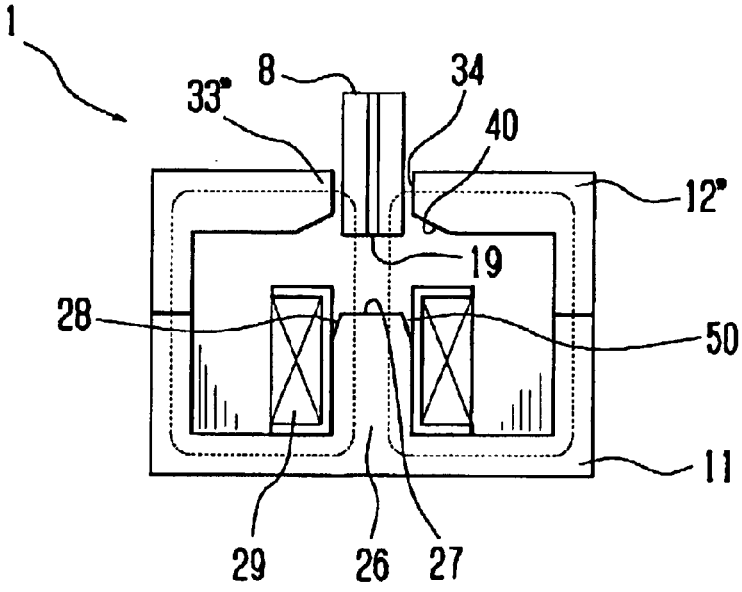
FIG. 14 is an explanatory diagram showing schematically a state in which a magnetic circuit formed by a single coil in an impact dot print head having a still another armature spacer according to the present invention, as well as portions related to the formation of the magnetic circuit, are seen in a direction orthogonal to the radial direction of the yoke.

FIG. 14 is an explanatory diagram showing schematically a state in which a magnetic circuit formed by a single coil 29 in an impact dot print head 1 having a still another armature spacer 12" according to the present invention, as well as portions related to the formation of the magnetic circuit, are seen in a direction orthogonal to the radial direction of the yoke 11. As is seen from FIG. 14, the armature spacer 12" used in this embodiment has side yoke portions 33" each having a face opposed to the associated core 26 which face is formed as a slant face 40 inclined in a direction away from the core 26.

Also in the armature spacer 12" having such side yoke portions 33", the slant faces 40 each extend in a direction away from the core and an end face of the armature spacer 12" is opposed to the armatures, so like the foregoing, a magnetic flux which tends to diffuse outwards from a position deviated from the inner periphery side of each coil 29 can be prevented from flowing directly from the associated core 26 to the armature spacer 12" without flowing through the armature 8", and the magnetic flux generated in the coil 29 can be allowed to flow efficiently from the core 26 to the armature spacer 12" through the magnetic circuit forming members 15 of the armature 8.

For example, the armature spacer 12" can be fabricated by metal forming (MIM). By metal forming, even an armature spacer 12" of a more complicated shape than the above shape can be fabricated with a high accuracy.

The armature spacer 12" can also be fabricated by cutting a plate-like base stock (not shown) of the armature spacer in such a manner that the position corresponding to each slant face 40 is inclined relative to the surface direction of the base stock. Cutting of sheet metal permits easy fabrication of the armature spacer 12".

Obviously, in view of the above description, many modifications and changes of the present invention may be made. Accordingly, it is understood that within the scope of appended claims the present invention may be practiced in different modes from those described above concretely.

What is claimed is:

1. An impact dot print head comprising:

a plurality of armatures each disposed so as to be pivotable within a pivotal plane and between a printing position and a stand-by position;

printing wires provided so as to move with pivotal motions of the armatures;

a yoke having cores with coils wound thereon respectively, the cores being arranged in opposition to the armatures respectively on the printing position side with respect to the armatures; and an armature spacer integrally provided with an abutting portion for abutment against the yoke and side yoke portions each positioned between adjacent said armatures, the side yoke portions extending in a direction away from the cores and so as to confront the armatures.

2. An impact dot print head according to claim 1, wherein the side yoke portions have opposite faces which are just in opposition to the armatures in a direction orthogonal to the pivotal plane of each of the armatures.

3. An impact dot print head according to claim 2, wherein the armature spacer is formed by pressing sheet metal, and the opposite faces are end faces obtained by the pressing.

4. An impact dot print head according to claim 3, wherein the side yoke portions are each inclined at an angle of not larger than 45 degrees relative to a sheet surface direction of the sheet metal.

5. An impact dot print head according to claim 3, wherein the side yoke portions are each inclined at an angle of 45 degrees relative to a sheet surface direction of the sheet metal.

6. An impact dot print head according to claim 2, wherein the side yoke portions are formed by cutting a base stock of the armature spacer.

7. An impact dot print head according to claim 2, wherein the side yoke portions are each formed by forming.

8. An impact dot print head according to claim 1, wherein the cores each have a pole face opposed to the associated one of the armatures and chamfered portions positioned in the direction of a line of intersection between the pole face and the pivotal plane and more spacedly from the side yoke portions than the pole face.

9. A printer comprising:

an impact dot print head including:

a plurality of armatures each disposed so as to be pivotable within a pivotal plane and between a printing position and a stand-by position;

printing wires provided so as to move with pivotal motions of the armatures;

a yoke having cores with coils wound thereon respectively, the cores being arranged in opposition to the armatures respectively on the printing position side with respect to the armatures; and an armature spacer integrally provided with an abutting portion for abutment against the yoke and side yoke portions each positioned between adjacent said armatures, the side yoke portions extending in a direction away from the cores and so as to confront the armatures;

a head drive mechanism for reciprocating the impact dot print head in a horizontal scanning direction;

a printing control means which causes, in accordance with printing data, the impact dot print head to be reciprocated by the head drive mechanism and which causes the armatures to pivot selectively; and a recording medium conveying mechanism which brings a recording medium into opposition to the impact dot print head in the reciprocative range of the impact dot print head and which conveys the recording medium in a vertical scanning direction orthogonal to the horizontal scanning direction in accordance with a printing control made by the printing control means.

10. A printer according to claim 9, wherein the side yoke portions provided in the impact dot print head have opposite faces which are just in opposition to the armatures in a direction orthogonal to the pivotal plane of the armatures.

11. A printer according to claim 10, wherein the armature spacer as a constituent of the impact dot print head is formed by pressing sheet metal, and the opposite faces are end faces obtained by the pressing.

12. A printer according to claim 11, wherein the side yoke portions provided in the armature spacer as a constituent of the impact dot print head are each inclined at an angle of not larger than 45 degrees relative to a sheet surface direction of the sheet metal.

13. A printer according to claim 11, wherein the side yoke portions provided in the armature spacer as a constituent of the impact dot print head are each inclined at an angle of 45 degrees relative to a sheet surface direction of the sheet metal.

14. A printer according to claim 10, wherein the side yoke portions provided in the armature spacer as a constituent of the impact dot print head are formed by cutting a base stock of the armature spacer.

15. A printer according to claim 10, wherein the armature spacer having the side yoke portions as a constituent of the impact dot print head are formed by forming.

16. A printer according to claim 9, wherein the cores as a constituent of the impact dot print head each have a pole face opposed to associated one of the armatures and chamfered portions positioned in the direction of a line of intersected between the pole face and the pivotal plane and more spacedly from the side yoke portions than the pole face.

* * * * *